United States Patent [19]

Kusmierski et al.

[11] 3,982,656

[45] Sept. 28, 1976

[54] CAN SEALER

[76] Inventors: Edward C. Kusmierski, 9323 Hasty Ave., Downey, Calif. 90241; John R. Lopez, 345 N. 6th St., Montebello, Calif. 90640; Phillip Silverman, 8535 W. Knoll St. No. 210, West Hollywood, Calif. 90069

[22] Filed: Oct. 10, 1975

[21] Appl. No.: 621,493

[52] U.S. Cl. ..... 220/238; 220/243; 220/315

[51] Int. Cl.[2] ..... B65D 53/00; B65D 45/00

[58] Field of Search ..... 220/243, 233, 234, 238, 220/315

[56] References Cited

UNITED STATES PATENTS

| | | | |
|---|---|---|---|
| 1,576,353 | 3/1926 | Olsen | 220/243 |
| 3,086,675 | 4/1963 | Clark, Jr. | 220/238 |
| 3,727,787 | 4/1973 | Gregory | 220/243 |

*Primary Examiner*—William Price
*Assistant Examiner*—Steven M. Pollard
*Attorney, Agent, or Firm*—Dominick Nardelli

[57] ABSTRACT

A can sealer (for closing an opening in the top cover of a metal food or beverage can) is disclosed wherein a resilient rubber-like cup is adopted to be placed over and covering the opening, and means are provided that reach down through the opening to engage the cover so that a compressive force is exerted on the resilient cup. In the preferred embodiment, the means includes a T-shaped member the stem of which protrudes through a central aperture in the cup. A rigid backup member is placed over the resilient cup and a camming lock means is coupled to the end of the stem so that, in one position of the lock means, the end of the T-shaped member is urged toward the cup and, in the second position this urging force is removed so that the cup is free to move along the stem of the T-shaped member.

6 Claims, 3 Drawing Figures

FIG. 1
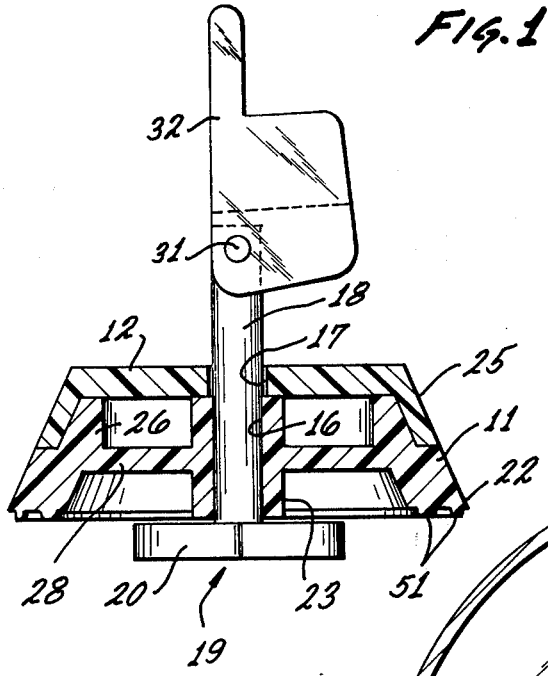
FIG. 3
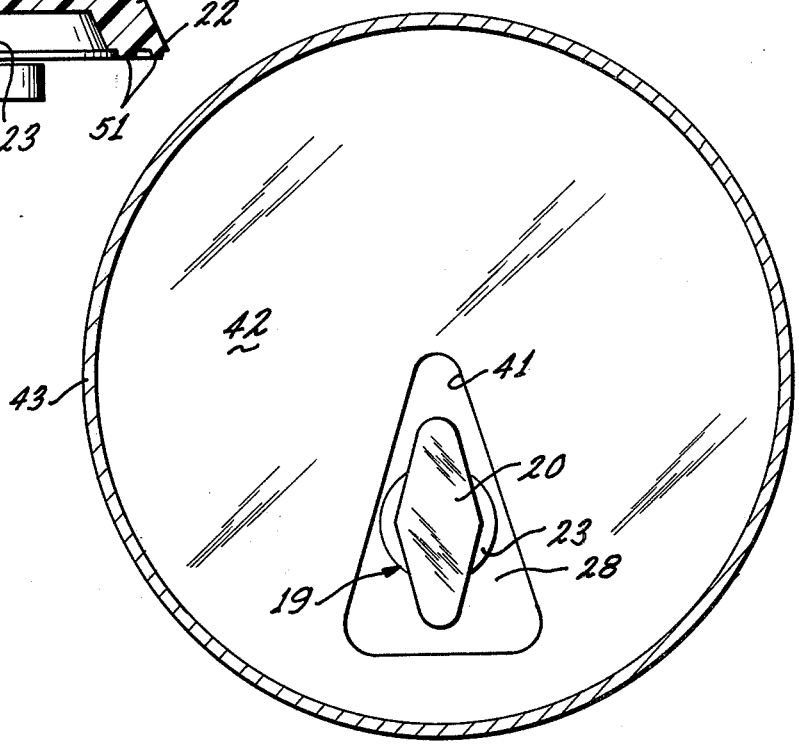
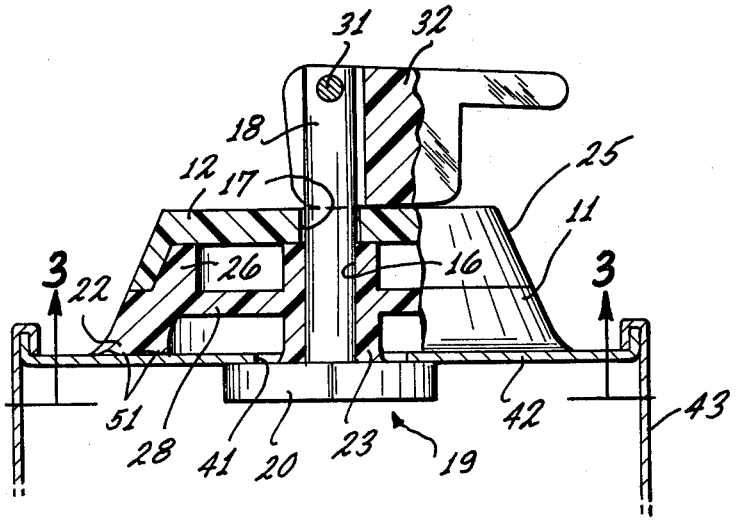
FIG. 2

CAN SEALER

FIELD OF THE INVENTION

This invention relates to a sealer for sealing an opening formed in a member and, more particularly, to an opening formed in a rigid flat surface.

BACKGROUND OF THE INVENTION

Resealing beverage cans of the pop-top type has been, up to now, a very trying experience especially if the beverage is carbonated. Carbonated beverages require an air-tight seal or the beverage will become flat. In the past, bottles with crown caps were readily resealable with snap-on resilient caps that fit over the mouth of the bottle. A cap of this type is impractical to seal an opening in a beverage can primarily because of the size of the can. Due to its size, most caps that snap on over the end of the can would be subjected to a large internal force if they are to be airtight, thereby tending to lift the cap off the can. This would require a strong securing means.

OBJECTS OF THE INVENTION

An object of this invention is to provide a can sealer that is simple, rugged, economical and effective.

Another object of this invention is to provide a can sealer that can be used effectively on many sized cans.

Another object of this invention is to provide a can sealer that has a positive locking action.

These and other objects and features of advantage will become more apparent after studying the following description of the preferred embodiment of our invention, together with the appended drawing.

BRIEF DESCRIPTION OF THE DRAWING

FIG. 1 is an elevation of the novel can sealer shown in partial section.

FIG. 2 is an elevation in partial section of the can sealer shown in a locked and sealing position, covering an opening in a can cover.

FIG. 3 is a view taken on line 3—3 of FIG. 2 in the direction of the arrows, showing a can sealer in its unlatched position.

DETAILED DESCRIPTION OF THE DRAWING

Referring to the drawing and to FIG. 1, in particular wherein the novel can sealer is shown in elevation, the sealer has a resilient cup 11 and a rigid backup member 12 mounted coaxial side by side. For reasons that will become apparent hereinafter, the resilient cup 11 is soft and pliable and is made, for example, of a rubber-like material, having a shore hardness of preferably 43 while the rigid member 12 is made of any rigid material such as hard plastic. The cup 11 and member 12 have axial apertures 16 and 17, respectively, through which extends a stem 18 of a T-shaped member 19 which also has a head 20 disposed at right angles to the stem 18. T-shaped member 19 is also rigid and preferably made of the same material that the backup member 12 is made of. The resilient cup 11 has a skirt 22 that preferably cones outward. Around the aperture 16 of cup 11 is disposed a boss 23. The aperture 16 and the stem 18 are preferably cylindrical in shape and the sizes are such that a snug interference fit is formed therebetween, while a loose fit is formed between stem 18 and aperture 17. To insure that the cup 11 and the backup member 12 are coaxial during use, the backup member

12 has a skirt 25 into which is nested a cylindrical flange 26 on cup 11. Therefore the boss 23 is preferably extended opposite the base 28 of the cup 11 the same axial distance that the flange 26 extends, so that they both make contact with the backup member 12. One can see that, as an alternative, the spacing between the flange 26 and the boss may be filled so that this surface of the cup is coextensive with the inner surface of the backup member. Pivotably mounted on the end of the stem 18 by a pin 23 is a locking handle 32 which is shaped so that when the handle is in the position shown in FIG. 1 stem 18 is free to move axially with respect to both cup 11 and backup member 12 and so that when the handle is in the position shown in FIG. 2 the head 20 is urged against the boss 23 and the handle 32 is urged against the backup member 12, thereby forming a compressive force in the boss 23.

Referring to FIGS. 2 and 3, the operation of the novel can sealer is shown. The can sealer has utility in sealing an oval opening 41 in a flat end cover 42 of a metal can having a cylindrical sidewall 43. To use the sealer, one inserts the head 20 into tne oval opening 41, as shown in FIG. 3. Then the head 20 is rotated 90° with respect to the can so that its ends extend under the periphery of opening 41 as shown in FIG. 2. The skirt 22 of cup 11 is positioned so that it rests on cover 42 concealing the opening 41. Then the handle is rotated downward 90° to the position shown in FIG. 2. This causes the head 20 to bear against the underside of cover 42 and the handle 32 urges the backup member 12 down against the cover 42. Since the cup 11 is resilient, the skirt 22 deforms, somewhat as shown, and the boss 16 is also compressed in the axial direction, since the boss 16 is constrained between the head 20 and backup cover 12. This axial compression of the boss 16 causes the interior walls of the aperture 16 to bear inward, forming an airtight seal between it and the stem 18. To insure also an airtight seal between the skirt 22 and the cover 42, the axial end of skirt 22 is formed with one or more circumferential grooves 51 as shown in FIG. 1.

Having described the preferred embodiment of our invention, one skilled in the art, after reading the above disclosure, can devise other embodiments without departing from the spirit of our invention. Therefore our invention is not to be considered limited to the embodiment as shown and described, but includes all embodiments falling within the scope of the appended claims.

We claim:

1. A can sealer for resealing an oval opening in a flat can cover, said sealer comprising:

a resilient member of a size to cover said opening;

said resilient member having a central aperture;

first means extending through said aperture and said opening in said can cover, and adopted to engage said cover;

second means in cooperation with said first means to cause said first means to bear against said cover to compress said resilient member between said cover and said second means;

said resilient member being in the shape of a cup having a base and a skirt attached to the periphery thereof;

a resilient boss disposed around said central aperture and within said skirt;

said first means including a T-shaped member having a stem and a head attached perpendicular thereto; and said stem being disposed through the central aperture with said head disposed on the same side of said base as said skirt.

2. The sealer of claim 1 wherein:

a rigid backup member having another central aperture is disposed adjacent to said resilient member opposite said skirt;

said stem is also disposed through said other central aperture of said rigid backup member.

3. The sealer of claim 2 wherein:

said backup member also has a skirt which is disposed adjacent to said resilient member;

said resilient member is shaped on the side adjacent to said backup member to conform substantially to the corresponding shape of said backup member.

4. The sealer of claim 3 wherein said second means comprises:

a handle;

third means for pivotably mounting said handle to the end of said stem so that said handle pivots about an axis perpendicular to said stem;

said handle is shaped so that when in a first pivotable position said backup and resilient members are free to move axially along said stem and in a second pivotable position said backup end and said resilient members are locked in an axial position with respect to said stem and are bearing against each other.

5. The sealer of claim 4 wherein:

said central aperture and said resilient member is cylindrical;

said stem is cylindrical; and the diameter of said aperture is less than the diameter of said stem so that a snug interference fit is formed therebetween.

6. The sealer of claim 5 wherein:

said skirt on said resilient member is flared radially outward; and the end surface of said skirt is formed with at least one circumferential groove.

* * * * *